US006609486B2

(12) United States Patent
Trappe et al.

(10) Patent No.: US 6,609,486 B2
(45) Date of Patent: Aug. 26, 2003

(54) DEVICE FOR CHANGING THE CONTROL TIMES OF GAS EXCHANGE VALVES IN AN INTERNAL COMBUSTION ENGINE

(75) Inventors: Michael Trappe, Bochum (DE); Eduard Golovatai-Schmidt, Röttenbach (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/222,426

(22) Filed: Aug. 16, 2002

(65) Prior Publication Data

US 2003/0051686 A1 Mar. 20, 2003

Related U.S. Application Data

(63) Continuation of application No. PCT/EP00/13091, filed on Dec. 21, 2000.

(30) Foreign Application Priority Data

Feb. 17, 2000 (DE) ..... 100 07 200

(51) Int. Cl.[7] ..... F01L 1/34

(52) U.S. Cl. ..... 123/90.17; 123/90.15; 123/90.16

(58) Field of Search ..... 123/90.15, 90.16, 123/90.17, 90.18; 92/120, 121, 122, 123, 124, 125, 5 R

(56) References Cited

U.S. PATENT DOCUMENTS 4,909,194 A * 3/1990 Bauer ..... 123/90.15
5,095,857 A 3/1992 Hampton et al.
5,367,992 A * 11/1994 Butterfield et al. ..... 123/90.17
5,836,277 A 11/1998 Kira et al.
5,870,983 A 2/1999 Sato et al.

FOREIGN PATENT DOCUMENTS

DE 19608652 A1 9/1997
EP 0675265 A1 10/1995
JP 11223113 8/1999

OTHER PUBLICATIONS

Hydraulic–Ring Publication: Continuous Cam Shaft Positioning—New System For Variable Control Timing ATZ Automobiltechnische, vol. 100, No. Suppl. 07/08, Jul. 1, 1998, pp. 60–62.

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A device for changing the control times of gas exchange valves in an internal combustion engine including a crankshaft driven component, and a camshaft component driven by a camshaft and affixed thereto is provided. The crankshaft driven component is connected to the camshaft component for power transmission via two pressure chambers. The pressure action causes a relative rotation or hydraulic adjustment of the camshaft component relative to the crankshaft driven component. In addition, the device has an impulse generator wheel fixed to the camshaft component, for ascertaining the position of the camshaft, and a spring attached to the two components for rotating the camshaft to a preferred position for starting the internal combustion engine. The spring is arranged outside the device in a hollow space located between the impulse generator wheel and the axial side facing the wheel, and is enclosed at least on two sides by the impulse-generator wheel.

6 Claims, 2 Drawing Sheets

DEVICE FOR CHANGING THE CONTROL TIMES OF GAS EXCHANGE VALVES IN AN INTERNAL COMBUSTION ENGINE

BACKGROUND

The invention relates to a device for changing the control times of gas exchange valves in an internal combustion engine, and it can be used advantageously, especially on hydraulic camshaft-adjustment devices.

A device of this general type is known from EP 0 806 550. This device, suitable essentially as a hydraulic adjustment device of the rotary piston type, is fixed at the drive side end of a camshaft located in the cylinder head of the internal combustion engine, and includes a crankshaft component driven by a crankshaft of the internal combustion engine and connected to the crankshaft, and a camshaft component fixed to the camshaft. The component connected to the crankshaft is designed as a drive wheel which forms a device casing, while the component fixed to the camshaft is shaped as a winged wheel inserted into the drive wheel, having several radial wings. Moreover, the component connected to the crankshaft is connected to the component fixed to the camshaft for power transmission through several pressure chambers located inside the device. When a hydraulic pressure is exerted on the pressure chambers alternately or simultaneously, it causes a rotation or hydraulic adjustment of the component fixed to the camshaft, relative to the component fixed to the crankshaft. This rotation or hydraulic adjustment causes a rotation of the camshaft relative to the crankshaft.

An impulse generator wheel is positioned at an axial side outside of the device to determine the position of the camshaft relative to the position of the crankshaft when the internal combustion engine is in operation. This impulse generator wheel is attached to the component fixed to the camshaft with the help of a central fastening screw of the device. In addition, a spring attached to the component fixed to the crankshaft as well as the component fixed to the camshaft is located in an additional hollow space inside the device. The spring is shaped as a torsion spring, and when the internal combustion engine is switched off, the spring rotates the camshaft into a preferred position for starting the internal combustion engine. The preferred position is made secure by an additional locking mechanism attached to the device. It is known from DE 197 26 300 A1, that this spring should be made of a flat spiral spring located in an additional space for springs in the device, or of a compression coil spring located in pressure chambers working in only one direction.

The disadvantage of using these known devices however, is that on one hand, the arch shaped positioning of the coil spring in the pressure chambers of the device imposes a heavy mechanical load, and consequently, causes a high degree of erosion. On the other hand, the torsion springs or spiral springs inside spaces meant for springs in the device require an enlarged axial length of the device, which is not practical in view of the very limited construction space in the cylinder head of the internal combustion engine or in the engine space of the vehicle. The relatively more expensive production and assembly of such devices with internally designed springs have proved to be disadvantageous in view of their high manufacturing costs. Even for devices that have springs housed in additional spaces meant for springs, there is the disadvantage that in order to rotate the camshaft to the preferred position for starting the internal combustion engine, these devices, used generally as intake camshafts, must counter the drag momentum caused by the valve movement in the internal combustion engine.

They cannot be used on exhaust camshafts or as combined intake/exhaust camshafts simply by removing the spring, without taking into account the construction space related disadvantages imposed by additional spaces meant for the springs in the device. Otherwise, an expensive construction and production of a variant of this device especially for exhaust or combined intake/exhaust camshafts is necessary. However, this would have a negative effect on the general endeavor of using identical components for both intake and exhaust camshafts. Thus, it will also have a negative impact on the manufacturing costs of both variants of the device.

SUMMARY

The object of the invention therefore is to provide a device for changing the control times of gas exchange valves in an internal combustion engine, in which the necessary springs for rotating the camshaft to a preferred position for starting the internal combustion engine are characterized by a simple and cost-effective assembly. The springs in the device should not be subjected to high mechanical loads, and they should not require an enlarged axial length of the device.

In accordance with the invention, this object is met by a device in which the spring is located outside the device in a hollow space between the impulse generator wheel and the axial side of the device facing it. In addition, the spring is enclosed on at least two sides by the impulse generator wheel.

In an advantageous further development of the invention, it is recommended that the spring should preferably be made of flat spiral spring with multiple windings, the inner end of which is fixed to the impulse generator wheel and the outer end of which is fixed to the component attached to the crankshaft of the device.

Such a spiral spring with single or multiple windings is wound at least once coaxially along its longitudinal axis and can, depending on the radial construction space available for the spring, be wound as often as desired. Alternately however, it is also possible to use a spiral spring having single or multiple windings, with a round or some other winding cross section, or to use a torsion spring instead, which can, depending on the axial construction space available for the spring, be wound once or multiple times.

As a further characteristic of the device according to the invention, it is recommended that the impulse generator wheel should preferably be made of a disk shaped sheet metal part, with a fastening flange extending coaxially to the device. With the help of this fastening flange, the impulse generator wheel and the component fixed to the camshaft are screwed to the camshaft by a central fastening screw. It is also possible to provide a separate fastening of the impulse generator wheel to the component fixed to the camshaft of the device. Alternately, it is also possible to use a disk-shaped or spoke wheel shaped impulse generator wheel produced in some other suitable way—for example as stamped component, sintered component or even plastic or ceramic part with inserted impulse marks.

Further, it is recommended that in forming the device according to the invention, the axial length of the coaxial fastening flange of the impulse generator wheel should have a hollow cylinder attached to the component fixed to the camshaft, and a hollow square to which the inner end of the flat spiral spring is terminally fixed. The implication is that the inner end of the flat spiral spring should preferably be shaped in such a way that it encloses at least three sides of the hollow square at the fastening flange of the impulse generator wheel, and thus locks the flat spiral spring on the fastening flange of the impulse generator wheel, preventing it from rotating.

The diameter of the hollow cylinder and the lateral length of the hollow square of the fastening flange are preferably created identical, and correspond roughly to the diameter of the central fastening screw head, with which the impulse generator wheel is attached to the component fixed to the camshaft of the device. However, it is also possible to have different sizes for the diameter of the hollow cylinder, and the lateral length of the hollow square of the fastening flange. It is also conceivable that the fastening flange for the flat spiral spring of the type described above, is shaped entirely as a hollow square to provide it with a partial or whole multiple edge hollow profile cross section, to which the inner end of the flat spiral spring can then be adjusted for terminal fixing on the fastening flange. It is also possible to have the entire axial length of the fastening flange shaped as a hollow cylinder, and to fix the uniform inner end of the flat spiral spring to the fastening flange tightly, with the help of a rivet, screw or a similar contrivance.

In contrast, in a further development of the device according to the invention, the outer end of the flat spiral spring is preferably built in the form of a hooked arc, and it is terminally fixed to a suspension point protruding axially from the component fixed to the crankshaft. It has proved to be particularly advantageous to have this suspension point for the flat spiral spring built as a part located on the component fixed to the crankshaft of the device through an extended casing screw or some other contrivance, as for example, in the case of rotary piston adjusters. This should be undertaken in such a way that the suspension points provided specifically for fastening the spring can be arranged on the crankshaft component. It is still possible to create the outer end of the flat spiral spring uniformly, without any further shape changes, and to fasten the same to the component fixed to the crankshaft of the device, with the help of a rivet or a screw.

Finally, in a further development of the device according to the invention, it is recommended that the rotating rim of the impulse generator wheel should preferably have several local bends as impulse marks, with which it can enclose the flat spiral spring from three sides.

The number of such impulse marks is usually based on the number of cylinders in the internal combustion engine. Their mutual alignment can be symmetrical or asymmetrical. These impulse marks are detected by an impulse-reading device aligned radially to the impulse generator wheel. This alignment has the effect that the flat spiral spring is also by and large enclosed, and it is integrated into the impulse generator wheel without wasting space. It is also conceivable that the rotating rim of the impulse generator wheel should have bends along its entire body and not just at fixed locations, and to provide radial bores or similar items as impulse marks, so that the flat spiral spring is enclosed completely by the impulse generator wheel.

The device according to the invention, for changing the control times of gas exchange valves of an internal combustion engine thus offers the following advantages over similar devices based on the latest technology. Arranging the spring (required for rotating the camshaft to a preferred position for starting the internal combustion engine) outside the device enables a completely problem-free and cost effective mounting of the spring in the device. In addition, a spring located outside the device is not subjected to the erosion-causing high mechanical loads that springs located inside the device are subjected to.

There is one more advantage. In comparison to prior existing devices in which the space between the impulse generator wheel and the device remains unused, this device in which the hollow space between the impulse generator wheel and the device is occupied by the flat spiral spring does not require the device to have an enlarged axial length.

This way, it is also possible to use a device in which there is a spring of the kind attached usually to the intake camshaft of the internal combustion engine, as an identical exhaust camshaft or a combined intake/exhaust camshaft of internal combustion engines, simply by removing the spring, without having to accept the disadvantage of limited construction space in the device attributable to the additional spaces for the spring.

BRIEF DESCRIPTION OF THE DRAWINGS

The invention has been explained in greater detail below based on a preferred embodiment. In the drawings.

DETAILED DESCRIPTION OF THE PREFERRED EMBODIMENTS

Figure 1:
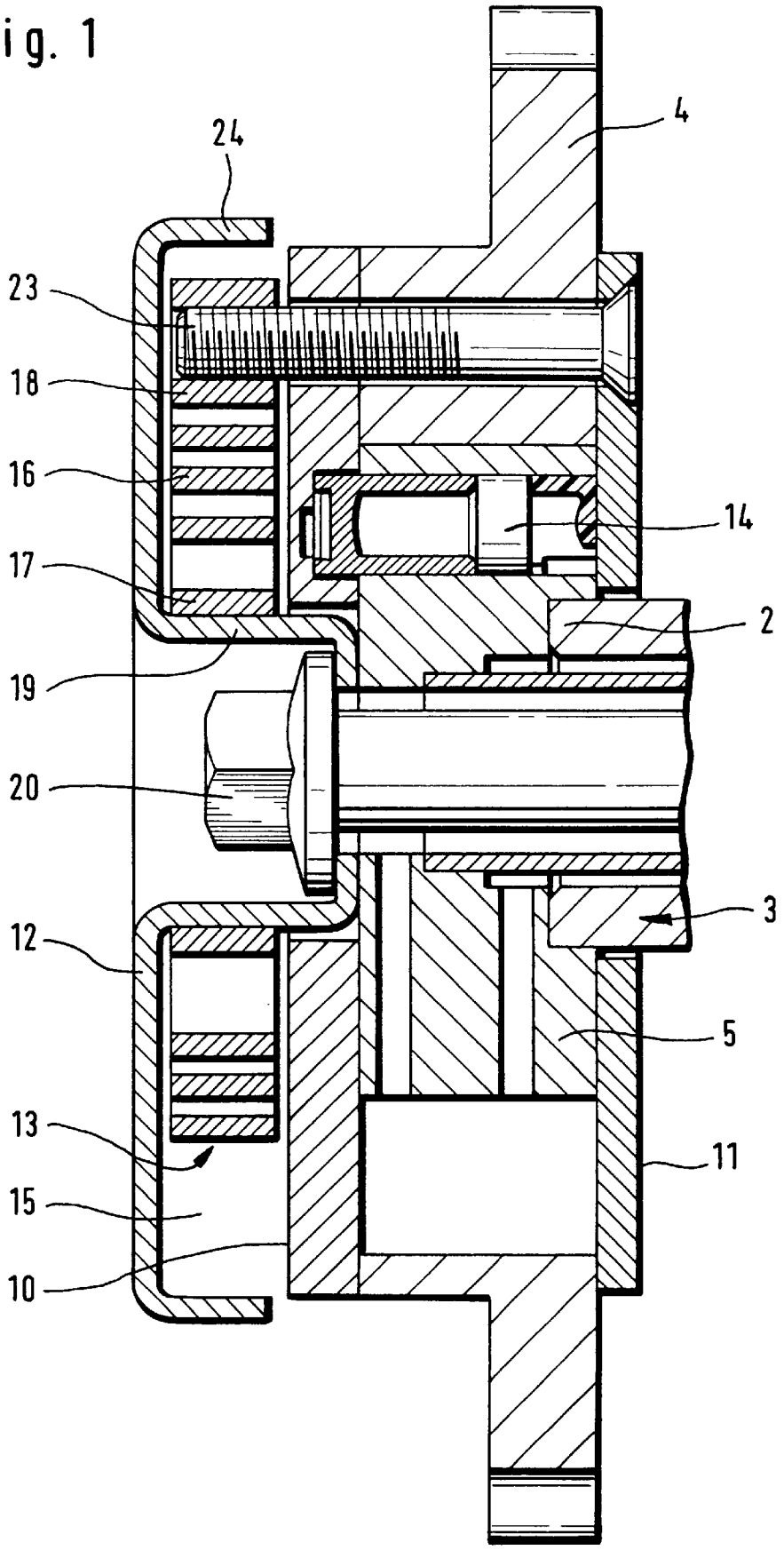
FIG. 1 is cross-sectional view of a device in accordance with the invention, of the rotary piston type, mounted on a camshaft.

FIG. 1 illustrates a device which is a rotary piston adjuster device 1 for changing the control times of gas exchange valves of an internal combustion engine. The device 1 is fixed at the drive-side end 2 of a camshaft 3 in the cylinder head of an internal combustion engine, and is formed essentially as a hydraulic adjustment drive. As can also be recognized in FIG. 2, this device 1 includes a crankshaft driven component 4 driven by a crankshaft of the device (not shown in the figure), and connected to the crankshaft, and a camshaft component 5 rotatably fixed to a camshaft 3. In the illustrated rotary piston adjuster device, these components have a chain wheel equipped with several hydraulic workspaces arranged in a hollow space 6, and a winged wheel with several wings 7 distributed radially to the wheel's circumference. The component 4 (formed as a drive wheel) fixed to the crankshaft is attached to the component 5 (shaped as a winged wheel) fixed to the camshaft for power transmission. The wings of the winged wheel divide each associated hydraulic workspace into two pressure chambers 8, 9. When these pressure chambers are acted upon alternately or simultaneously by a hydraulic pressure, a rotation or a hydraulic adjustment of the component 5 fixed to the camshaft takes place relative to the component 4 connected to the crankshaft, which translates eventually into a rotation or hydraulic adjustment of the camshaft 3 relative to the crankshaft.

Figure 2:
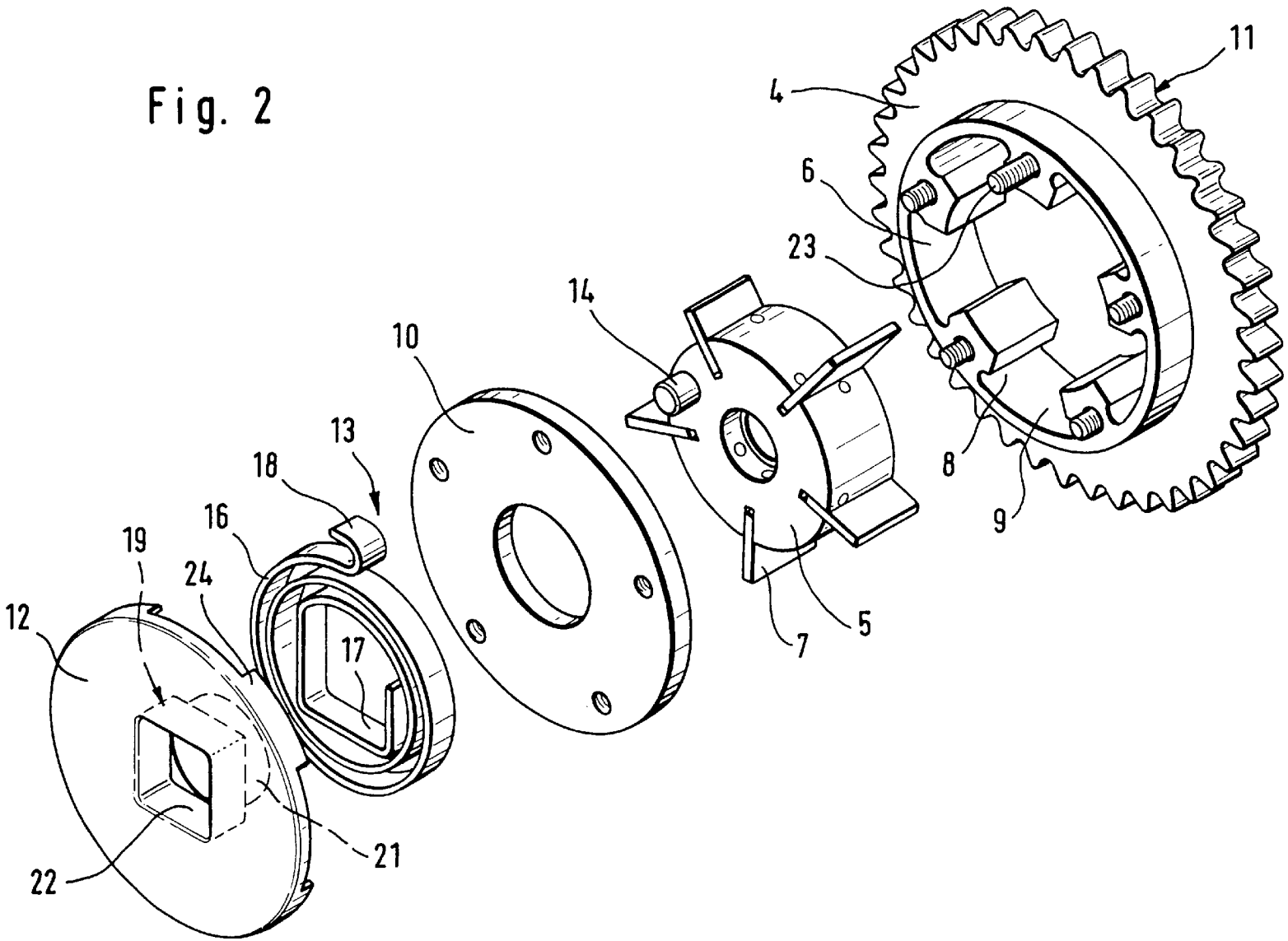
FIG. 2 is a schematic diagram of the device of FIG. 1 in accordance with the invention.

Further, it can be seen in FIGS. 1 and 2 that the axial sides 10 and 11 of the device 1 are built as two disk-shaped caps. An impulse generator wheel 12 is placed against the axial side 10 outside the device 1, which is attached to the component 5 fixed to the camshaft. When the internal combustion engine is in operation, the position of the camshaft 3 relative to the position of the crankshaft can be determined with the help of the impulse generator wheel 12, by any of several well known methods. In addition, the device 1 has a spring 13 attached to both the component 5 fixed to the camshaft 3 and the component 4 fixed to the crankshaft. When the internal combustion engine is switched off, the spring 13 rotates the camshaft 3 to a position that is favorable for starting the internal combustion engine. When no pressure is exerted, this favorable position is secured through an additional locking device (14).

As this type of spring 13 previously required an enlarged axial length of the device 1, the spring 13 according to the invention is placed outside the device 1 in a hollow space between the impulse generator wheel 12 and the facing axial side 10 of the device 1. As can be seen in FIGS. 1 and 2, the spring 13 is made of a multiple winding, flat spiral spring (16), the inner end 17 of which is fixed terminally to the impulse generator wheel 12, and the outer end 18 of which is fixed terminally to the crankshaft driven component 4 of the device 1.

The impulse generator wheel 12 is made of a disk shaped sheet metal part with a coaxial fastening flange 19 that extends up to the device 1. With the help of this flange 19, the impulse generator wheel 12 and the component 5 fixed to the camshaft of the device 1 are screwed to the camshaft 3 through a central fastening screw 20. As is clear from FIG. 2, a section of the coaxial length of the fastening flange 19 is shaped as a hollow cylinder 21 with which it is attached to the component 5 fixed to the camshaft 3 through the axial length 10 of the device 1. In contrast, a section of the coaxial length of the flange 19 adjacent to the impulse generator wheel 12, is shaped as a hollow square 22, on which the inner end 17 of the flat spiral spring 16 is terminally fixed. For this purpose, the inner end 17 of the flat spiral spring 16 is shaped in such a way that it encloses three sides of the hollow square 21 at the fastening flange 19 of the impulse generator wheel 12, and thus arrests the flat spiral spring 16 terminally on the impulse generator wheel 12. As against this, the outer end 18 of the flat spiral spring 16 is shaped as an arc of angled hooks that are fixed to an axially extending suspension point 23 in the crankshaft component 4 of the device 1. The suspension point 23 is connected terminally to the rotary piston adjuster illustrated in FIGS. 1 and 2 with the help of an extended box screw. Additionally, the suspended disk rim of the impulse generator wheel 12 has several local bends 24 through which the impulse generator wheel 12 encloses the flat spiral spring 16 in a by and large radial orientation. These bends 24 are at the same time shaped as impulse marks symmetrical to one other. The impulse marks are connected to an impulse-reading instrument (not shown in the Figures), aligned radial to the impulse generator wheel 12.

REFERENCE NUMBER LIST

1 Device
2 Drive side end
3 Camshaft
4 Component fixed to crankshaft
5 Component fixed to camshaft
6 Hydraulic workspace
7 Wing
8 Pressure chamber
9 Pressure chamber
10 Axial side
11 Axial side
12 Impulse generator wheel
13 Spring tool
14 Locking device
15 Cavity
16 Flat spiral spring
17 Inner end
18 Outer end
19 Fastening flange
20 Fastening screw
21 Hollow cylinder
22 Hollow square
23 Suspension point
24 Bends

What is claimed is:

1. A device for changing the control times of gas exchange valves in an internal combustion engine, comprising:

a crankshaft driven component fixed to a crankshaft of the internal combustion engine and driven by the crankshaft, and a camshaft component fixed to a camshaft, the crankshaft driven component and the camshaft component are connected to each other for power transmission through at least two pressure chambers located inside the device that are acted upon either alternately or simultaneously by hydraulic pressure, upon the pressure chambers being acted upon, the camshaft component rotates relative to the crankshaft driven component so that a hydraulic adjustment takes place between the two components, and the relative rotation or hydraulic adjustment also takes place between the crankshaft and the camshaft, an impulse generator wheel located outside the device and attached in a rotatably fast manner to the camshaft component for determination of the camshaft position relative to the crankshaft position along an axial side, a spring attached to the crankshaft driven component and the camshaft component fixed to the camshaft to rotate the camshaft to a preferred position for starting the internal combustion engine when the internal combustion engine is shut down, wherein the spring is placed outside the device in a hollow space located between the impulse generator wheel and an axial side facing it, and the spring is enclosed at least on two sides by the impulse generator wheel.

2. The device according to claim 1, wherein the spring is formed of flat spiral spring wound multiple times, an inner end of the spring is fastened to the impulse generator wheel and an outer end of the spring is fastened to the crankshaft driven component.

3. The device according to claim 1, wherein the impulse generator wheel is made of a disk shaped sheet metal part with a coaxial fastening flange extending to the device, the impulse generator wheel is connected to the camshaft together with the camshaft component with the help of a central fastening screw.

4. The device according to claim 3, wherein the coaxial fastening flange of the impulse generator wheel is shaped as a hollow cylinder placed on the camshaft component, and as a hollow square to which the at least partially formed complementary inner end of the flat spiral spring is terminally fixed.

5. The device according to claim 3, wherein the outer end of the flat spiral spring has hook shaped angles, and is fixed terminally to an axially extending suspension point of the crankshaft driven component.

6. The device according to claim 3, wherein the impulse generator wheel has several localized bends as impulse marks on a rotating disk rim, with which it encloses the flat spiral spring (16) on three sides.

* * * * *